United States Patent [19]

Haglund et al.

[11] 4,440,087

[45] Apr. 3, 1984

[54] FIRING INITIATING DEVICE

[75] Inventors: Ingemar B. Haglund, Gyttorp; Nils A. L. Westerlund, Fjärås, both of Sweden

[73] Assignee: Nitro Nobel Aktiebolag, Gyttorp, Sweden

[21] Appl. No.: 316,528

[22] Filed: Oct. 29, 1981

[30] Foreign Application Priority Data

Oct. 31, 1980 [SE] Sweden ..... 8007673

[51] Int. Cl.[3] ..... F42C 19/08

[52] U.S. Cl. ..... 102/275.11

[58] Field of Search ..... 102/275.6, 275.11, 275.12, 102/200; 361/247, 248, 251, 253, 257

[56] References Cited

U.S. PATENT DOCUMENTS 970,889 9/1910 Conings ..... 102/275.11

4,106,073 8/1978 Hedberg .

FOREIGN PATENT DOCUMENTS 7412541 4/1976 Sweden .

7813049 12/1978 Sweden .

15098 of 1911 United Kingdom ..... 102/275.11

*Primary Examiner*—Charles T. Jordan

*Attorney, Agent, or Firm*—Fleit, Jacobson, Cohn & Price

[57] ABSTRACT

A pressure impulse for initiating a pressure-impulse initiatable fuse is generated by an electric discharge created in a spark gap between electrodes of mutually opposite polarity. There are used electrodes which are movable relative to one another and voltage is applied to the electrodes when the distance between the electrodes is too great for an electric discharge to take place therebetween, whereafter the electrodes are caused to approach each other at least until a discharge occurs.

6 Claims, 4 Drawing Figures

II
78
86
76
76
77
77
79
81
75
80
45
46
50
74
49
51
56
87
58
57
59
52
48
65
60
61
63
SERVO
MOTOR
62
II 47
82
78
86
76
77
85
84
81
79
83
75
80
74
46
51
87
58
56
45
59
57
48
52
MEANS FOR
CONNECTING
65
66
53
55
69
63
SERVO
MOTOR
61
71
72
62
67
68
70
73
54
MEANS FOR CONNECTING

FIRING INITIATING DEVICE

The present invention relates to a method in and a device for initiating a pressure-impulse initiatable fuse.

Pressure-impulse initiatable fuses, particularly NONEL®-tubes comprising a plastics hose or tube of small diameter and coated internally with an explosive material, have been used extensively in recent years, because of their insensitivity to electrical disturbances. When the distance between the firing point and the explosive charges at the blasting site, which charges are coupled together with the aid of such fuses, can be safely kept relatively short, the charges are fired, to advantage, through a fuse which is also initiatable by a pressure impulse, drawn between the blasting site and the firing point, whereat the pressure impulse which initiates the firing fuse can be generated by means of a starter's-pistol cartridge or some other small explosive charge. However, when, for safety reasons, a longer distance is required between the firing point and the blasting site this method of firing the charges is encumbered with a number of disadvantages, in the form of the considerable costs for the firing fuse itself and for the work entailed in laying said fuse between the firing point and said site, and in the form of risks of a malfunction due to the firing fuse being damaged during and subsequent to the work of laying the relatively long firing fuse between said firing point and the blasting site. In those rare cases where compressed-air hoses extending to the vicinity of the blasting site are provided, the compressed air can be used for remote control of initiation devices for generating pressure impulses (see for example SE Patent Specification Nos. 7412541-0 and 7813049-9), although in general the only practical method of procedure which can be applied when the firing point and the blasting site are relatively far apart, is to initiate the pressure-impulse sensitive firing fuse by means of an electric detonating cap which can be fired by remote control, although a large part of the increased safety afforded by the pressure-impulse initiatable fuses is then lost. It will be understood that the latter method of procedure can not be applied at all when the risk of electrical disturbances is too great to permit the use of electric detonating caps. In this latter case, compromises have been applied in which pressure-impulse initiatable firing fuses have been used and the distances between the blasting site and the firing point have been made shorter than otherwise desirable from the safety aspect with respect to personal injury as a result of exploding dust, sulphur fires, etc.

The object of the present invention is to provide a novel method and novel device for initiating pressure-impulse initiatable fuses, in which the aforementioned disadvantages can be at least substantially eliminated.

To this end there is proposed in accordance with the invention a method for initiating a pressure-impulse initiatable fuse, comprising generating the pressure impulse required for initiating said fuse by creating an electric discharge in a spark gap between electrodes of mutually opposite polarity;

using electrodes which are movable relative to one another;

applying voltage to the electrodes when the distance therebetween is too great to permit a discharge to take place; and thereafter causing the electrodes to approach each other at least until an electric discharge occurs. In this way, the risk of an unintentional discharge due to the action of earth currents, thundery weather and other electrical disturbances becomes practically nil, while an intentional discharge can be obtained by using well-tested remote-control principles, for example substantially those disclosed in U.S. Pat. No. 4,106,073.

As beforementioned, the invention also relates to a device for initiating a pressure-impulse initiatable fuse, said device including a holder for holding a fuse in a given position, and a pair of electrodes arranged in a chamber having an open side facing a fuse placed in the holder, preferably facing an end of said fuse, wherein said electrodes form part of an electric circuit arranged to generate a pressure impulse required for initiating said fuse, by creating an electric discharge in a spark gap between the electrodes, and wherein said electrodes are movable relative to one another between positions in which they are located at a distance apart which is too great for a discharge therebetween to take place and positions where the distance between said electrodes is such as to permit a discharge to take place.

In addition to affording a particularly high degree of safety against unintentional initiation, the method and the device according to the invention also obviate the need of providing switch means in the discharge circuit incorporating the electrodes for closing the circuit. Such switch means would be subjected to very high stresses and strains as a result of the large quantities of energy momentarily transferred when closing the discharge circuit, rendering it necessary to change the switch means after each initiating cycle, or after just a few initiating cycles. When practicing the method or using the device according to the invention, however, the discharge circuit is charged with the electrodes located at a safe distance apart, whereafter the circuit is closed by causing the electrodes to approach each other. The electrodes can then be made of such a material and given such a design which enables the electrodes to be kept intact over several hundred firing cycle. Thus, the invention constitutes a large step forward in comparison with the known technique.

Preferably, said chamber widens in a direction towards said open side.

The device according to the invention may to advantage include a ring-shaped, first electrode which is located adjacent the open side of the chamber and which electrode preferably forms part of the chamber wall and a second electrode which is movable at least substantially coaxially with the first electrode towards and away from said open side.

According to one advantageous embodiment the fuse holder may include a resiliently compressible element having a hole for receiving the fuse, and means for compressing said element in the longitudinal direction of the hole, so as to cause the element to expand in the transverse direction of said hole, to reduce the diameter of said hole and therewith fix the position of the fuse.

The invention will now be described with reference to an exemplary embodiment thereof illustrated in the accompanying drawings.

Figure 1:
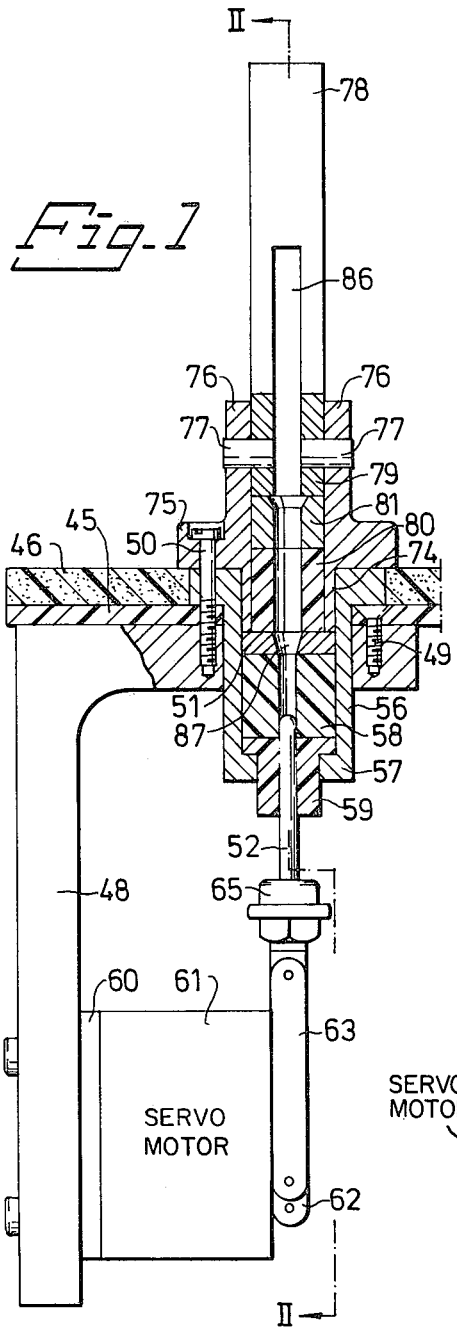
FIG. 1 illustrates partly in section and partly in side view a device according to the invention.

The initiating device illustrated in FIGS. 1–4 is incorporated in a remotely controlled firing apparatus (only partially illustrated) having a casing which is formed of parts 45 and 46 and which has a carrying handle 47. The initiating device is supported by an L-shaped metallic bracket structure 48 attached to the casing 45, 46 by screws 49, 50. The initiating device includes a first, ring-shaped electrode 51 and a second, rod-like electrode 52. These electrodes are connected, through electrical conductors 53, 54 to a capacitor of large capacitance which is shown symbolically at 55 and which is arranged to be charged to a high voltage, e.g. a voltage of about 4000 V, from an external current source. The firing apparatus, which may be substantially of the kind described and illustrated in U.S. Pat. No. 4,106,073, may include means for transforming the voltage applied from the external current source, for example a telephone network, to the high voltage required for the capacitor 55.

The electrode 51 is accommodated in a metallic sleeve 56 having a lower, inwardly projecting flange 57, and rests on said flange via bushings 58, 59 made of a rigid, insulating material. The central holes of the bushings 58, 59 receive and guide the electrode 52, which can be moved backwards and forwards in the bushings 58, 59 between the position shown in FIGS. 1, 2 and 4 and the position shown in FIG. 3 by means of an electric servomotor 61 mounted on the bracket structure 48 via an electrically insulating insert 60. For this purpose the motor 61 has a drive lug 62 which projects through a slot in the motor casing and which is connected to an attachment 65 for the electrode 52 via a link 63. The attachment 65 also carries a connector 66 by which the electrode is connected to the capacitor 55, preferably its negative pole, through the conductor 53.

The servomotor 61 is connected to a source of electrical driving current via electrical conductors 67, 68. The block 69, 70 illustrate symbolically means for connecting the capacitor 55 and the servomotor 61 to an associated current-supply source and for reversing the direction of current to the servomotor in response to remote-control signals incoming on conductors 71, 72. To this end, the electrode 51 is connected to the positive pole of the capacitor 55, via the metal sleeve 56, the metal bracket structure 48, the connecting terminal 73 and the conductor 54.

The ring-shaped electrode 51 is held pressed against the bushings 57, 58 by means of a sleeve-like part 74 which extends axially into the sleeve 56 from a flange 75 abutting the upper end of said sleeve. The flange 75, which is fixed relative to the sleeve 56, has two upwardly projecting lugs 76 in which a two-arm lever is pivotally mounted by trunnions 77, the arms of which lever are referenced 78 and 79, respectively. One of said arms, here referenced 78, is longer than the other and forms a handle for facilitating rotation of the lever about the trunnions 77.

The flange 75 and the part 74 are through-passed by an axial, cylindrical bore in which there is arranged a cylindrical bushing 80 of a resilitently compressible material and a bushing 81 of rigid material located thereabove. The holes passing axially through the bushings 80, 81 are dimensioned to conform to, and to guide, one end of a tubular, pressure-impulse initiatable fuse 82, preferably a so-called NONEL ®-tube, whereat the upper end of the hole of bushing 81 has been widened to facilitate the insertion of said fuse.

The lever arm 79 abuts the upper end of the bushing 81 through one of the surfaces 83, 84 and 85 of said lever arm, depending upon the position of rotation of the lever 78, 79. In this respect, the lever 78, 79 is provided with an opening 86 which exposes the hole extending axially through the bushing 81, when the surfaces 83 and 84 of said lever abut said bushing. The distance between the pivot centre of the lever 78, 79 and the lever surface 83 is shorter than the distance between the pivot centre and the lever surface 84, this latter distance, in turn, being shorter than the distance between the pivot centre of the lever 78, 79 and the lever surface 85. When the surface 83 lies against the bushing 81, said lever exerts no particular force on the bushing 81 and the underlying compressible bushing 80. When the lever 78, 79 is swung to the position illustrated in FIG. 3 after having inserted the said end of said fuse into abutment with the upper side of the ring-shaped electrode 51 according to FIG. 2, the bushing 81 is pressed downwardly somewhat in the bore of the flange 75 and sleeve part 74, while compressing the bushing 80 axially. As a result, the bushing 80 expands laterally, to clamp the fuse 82 relative the chamber 87 formed by the cavity in the annular electrode 51 and the hole in the bushing 58.

Figure 4:
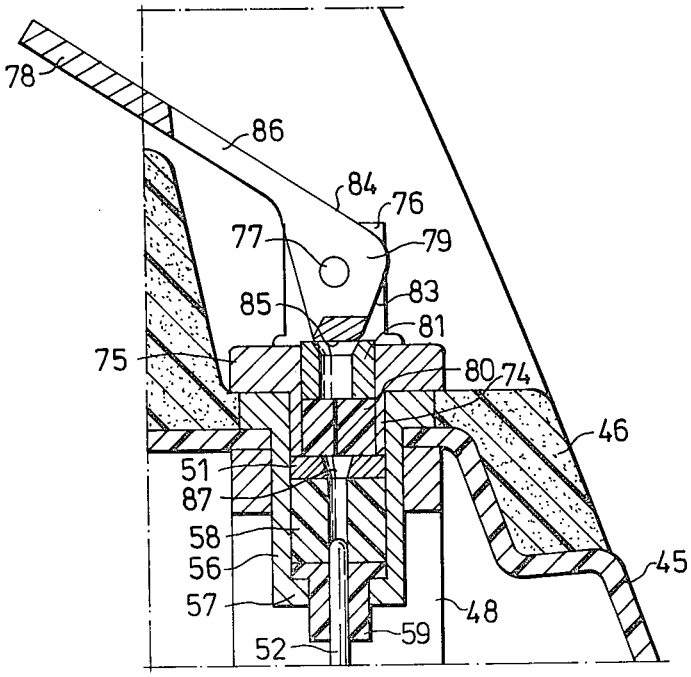
FIG. 4 illustrates a part of the arrangement shown in FIG. 2 with the fuse removed and the holder in a transport position.

FIG. 4 illustrates the state of the firing initiating device when stored or being transported. In this state of the device, the lever 78, 79 is swung so that the surface 85 of the arm 79 covers the hole in the bushing 81 and simultaneously presses the bushing 81 down to an extent such as to compress the bushing 80 to a degree at which the hole of the bushing 80 is substantially closed.

Figure 2:
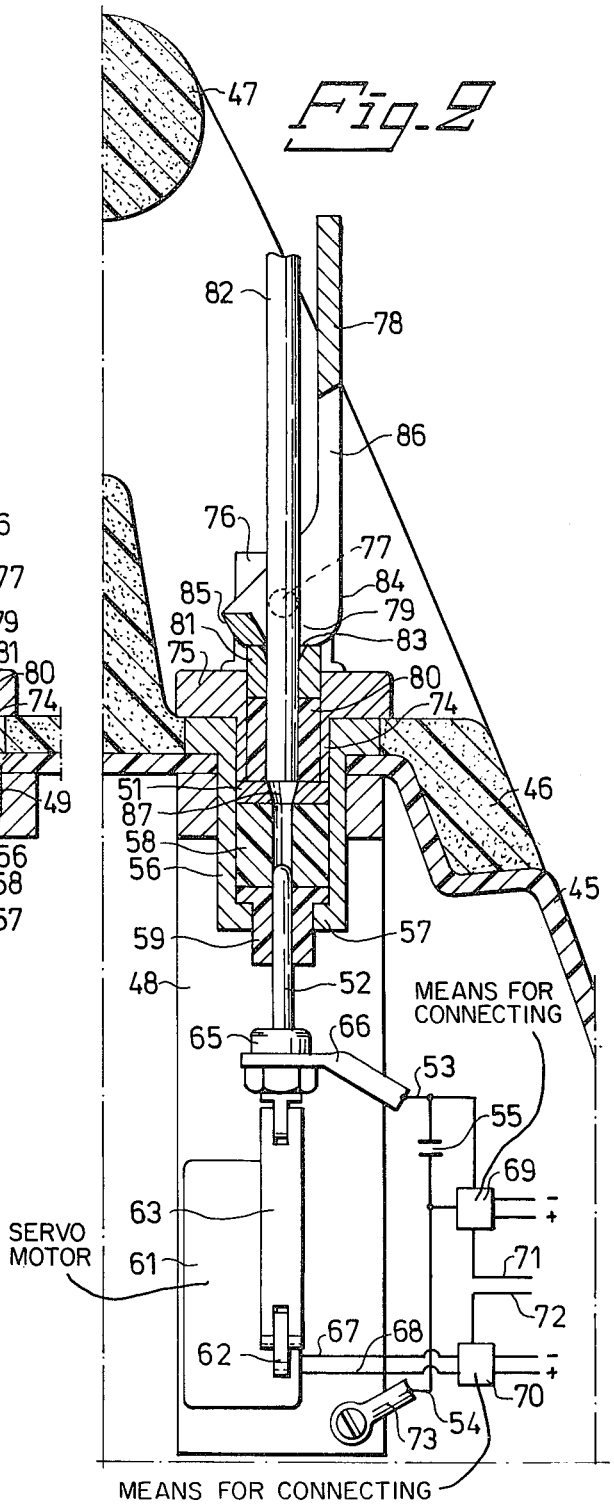
FIG. 2 is a view taken on the line II—II in FIG. 1 illustrating parts of the casing of a firing apparatus incorporating the device according to the invention, associated electrical equipment, and a fuse placed in a holder.
Figure 3:
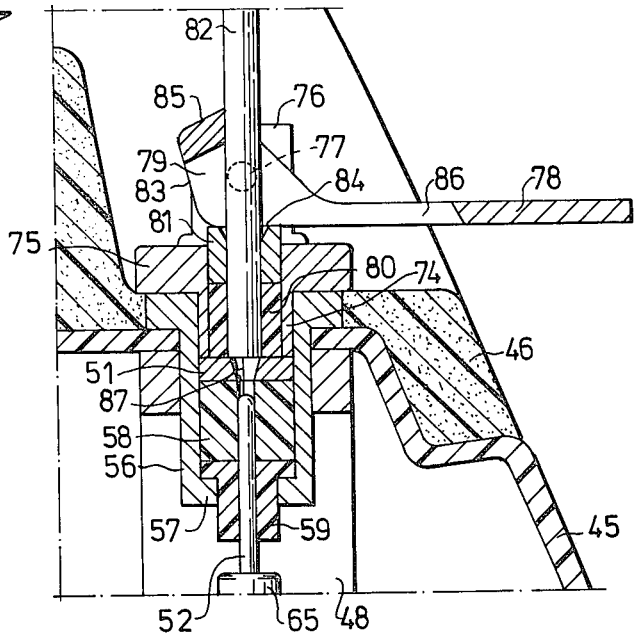
FIG. 3 illustrates a part of the arrangement shown in FIG. 2 with the fuse holder in a fuse-holding position and with the electrodes in a discharge position.

When using the firing initiating device according to FIGS. 1–4, the lever is swung from the position shown in FIG. 4 to the position shown in FIGS. 1 and 2, the fuse 82 then being inserted into the bushings 81, 80 in the manner illustrated in FIG. 2. The end of the fuse is then locked in the holder formed by the bushings 80 and 81 and the lever 78, 79 by swinging said lever to the position shown in FIG. 3, and the capacitor 55 is charged with the electrode 52 withdrawn to the position illustrated in FIGS. 1, 2 and 4, the distance between the electrodes 51, 52 being too great for an electric discharge to occur therebetween. Finally, current is supplied to the servomotor 61, which then drives the electrode 51 to the position illustrated in FIG. 3, whereat a substantially instantaneous electric discharge takes place between the electrodes 51, 52, giving rise to a powerful pressure impulse which fires the fuse 82. The chamber 87 widens in a direction towards the end of the fuse which gives rise to a pressure impulse of optimal characteristics.

The invention is not restricted to the described and illustrated embodiment. Instead, the manner in which the invention is put into effect can be varied in many ways within the scope of the invention set forth in the following claims.

We claim:

1. A device for initiating a pressure-impulse initiatable fuse, said device including a holder for holding a fuse in a given position, and a pair of electrodes arranged in a chamber having an open side facing a fuse placed in the holder, wherein said electrodes form part of an electric circuit arranged to generate a pressure impulse required for initiating said fuse, by creating an electric discharge in a spark gap between the electrodes, and wherein said electrodes are movable relative to one another between positions in which they are located at a distance apart which is too great for a discharge therebetween to take place and positions where the distance between said electrodes is such as to permit a discharge to take place.

2. A device according to claim 1, wherein the open side of said chamber faces the end of a fuse placed in position in said holder.

3. A device according to claim 1 or 2, wherein the chamber widens in a direction towards said open side.

4. A device according to claim 1 or 2, including a ring-shaped, first electrode which is located adjacent the open side of the chamber and a second electrode which is movable at least substantially coaxially with the first electrode towards and away from said open side.

5. A device according to claim 4, wherein said first electrode forms part of the wall of said chamber.

6. A device according to claim 1 or 2, characterized in that the holder includes a resiliently compressible element having a hole for receiving the fuse, and means for compressing said element in the longitudinal direction of the hole, so as to cause the element to expand in the transverse direction of said hold, to reduce the diameter of said hole and therewith fix the position of the fuse.

* * * * *